United States Patent [19]

Specktor

[11] 4,248,079

[45] Feb. 3, 1981

[54] TRAM FOR USE IN AN APPARATUS FOR REPAIRING AND STRAIGHTENING

[76] Inventor: Gerald A. Specktor, 409 Cleveland Ave. S., St. Paul, Minn. 55105

[21] Appl. No.: 32,609

[22] Filed: Apr. 23, 1979

Related U.S. Application Data

[62] Division of Ser. No. 496,848, Aug. 12, 1974, Pat. No. 4,151,737.

[51] Int. Cl.[3] ..... B21D 1/12

[52] U.S. Cl. ..... 72/465; 72/705; 187/8.43

[58] Field of Search ..... 72/705, 465; 187/8.45, 187/8.67, 8.43; 269/90

[56] References Cited

U.S. PATENT DOCUMENTS

| | | | |
|---|---|---|---|
| 2,013,785 | 9/1935 | Merrill | 72/705 |
| 3,106,988 | 10/1963 | Hott | 187/8.45 |
| 3,257,838 | 6/1966 | Spears | 72/705 |
| 3,269,169 | 8/1966 | Latuff et al. | 72/705 |
| 3,365,026 | 1/1968 | Mancini | 187/8.43 |
| 3,626,747 | 12/1971 | Rouis | 72/705 |
| 3,798,956 | 3/1974 | Kopczynski | 72/422 |
| 3,888,100 | 6/1975 | Chisum | 72/705 |

*Primary Examiner*—Lowell A. Larson
*Attorney, Agent, or Firm*—Wicks & Nemer

[57] ABSTRACT

A tram is disclosed, in its preferred form, for use in an apparatus for repairing and straightening. In the preferred embodiment, the tram includes a tram carrier member including first and second side walls. The tram is mounted between right and left track members by a shaft which extends through U-shaped apertures in the side walls and has a first end which engages a portion of the right track and a second end which engages a portion of the left track. The tram is moved by rotating the shaft by the use of an electric motor. Further, sprockets are provided on the first and second ends of the shaft which engages first and second stationary, elongated gear members located on the right and left track members forming a rack and pinion gear arrangement to allow movement of the tram. A steel roller is further provided on the shaft adjacent the sprockets to reduce the amount of weight carried by the sprockets and to allow the sprockets to mesh with the elongated gear members. The shaft further includes a flexible coupler adjacent its center to allow the shaft to flex. The tram also includes spring loaded bearing retainers slidably mounted to the side walls for resiliently mounting the shaft in the tram body. The tram includes a tram top which extends over the top surface of the tread member and a tram bottom which extends over the bottom surface of the tread member to receive the counterforce which the tram body is subjected by force applying members which are pivotally mounted to the tram.

24 Claims, 5 Drawing Figures

TRAM FOR USE IN AN APPARATUS FOR REPAIRING AND STRAIGHTENING

CROSS REFERENCE

This is a division of application Ser. No. 496,848 filed on Aug. 12, 1974, now U.S. Pat. No. 4,151,737.

BACKGROUND

This invention relates generally to a tram and more particularly, in the preferred embodiment, to a tram for use in an apparatus for repairing and straightening.

In the field of vehicle frame and body repairing and straightening, various types of apparatus are currently available, each of which present serious limitations and deficiencies regarding the ability of repair personnel to allow the easy placement of the force applying members at the desired position. Therefore, there is definite need in the art for a tram which allows easy placement of the force applying members adjacent to the vehicle in any desired position in a minimal amount of time and effort. Further, the apparatus should be of a simple design, efficient, and easy to operate to maximize equipment and materials used.

SUMMARY

The present invention solves these and other problems in vehicle repairing and straightening by providing, in the preferred embodiment, a tram for use in an apparatus for repairing and straightening the body and frame of a wheeled vehicle. The preferred embodiment of the tram includes a tram carrier member having a first side wall and a second side wall, with each of the sidewalls including a U-shaped aperture formed therein. A shaft extends through the U-shaped apertures of the side walls of the tram carrier member and engages with a portion of the apparatus for repairing and straightening. The tram further includes shaft retainers slidably mounted to the sidewalls for capturing the shaft within the U-shaped apertures of the sidewalls. The shaft retainers are biased for allowing the shaft to deflect under a load condition.

In the preferred embodiment of the present invention, the tram further includes a tram top and bottom which engage with the apparatus for repairing and straightening under a load condition.

Therefore, it is a primary object of this invention to provide a novel tram.

It is also an object of this invention to provide such novel tram for use with an apparatus for repairing and straightening.

It is also an object of this invention to provide such novel tram including means for moving the tram within the apparatus for repairing and straightening without a large expenditure of time and effort.

It is also an object of this invention to provide such novel tram allowing easy placement of force applying members at the desired position in a minimal amount of time and effort.

It is also an object of this invention to provide such novel tram including counterforce receiving members.

It is also an object of this invention to provide such novel tram which is of simple design, efficient, and easy to operate.

It is also an object of this invention to provide such novel tram which maximizes the equipment and materials used.

These and further objects and advantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where.

Figures 2, 5, 6, 8, 9:
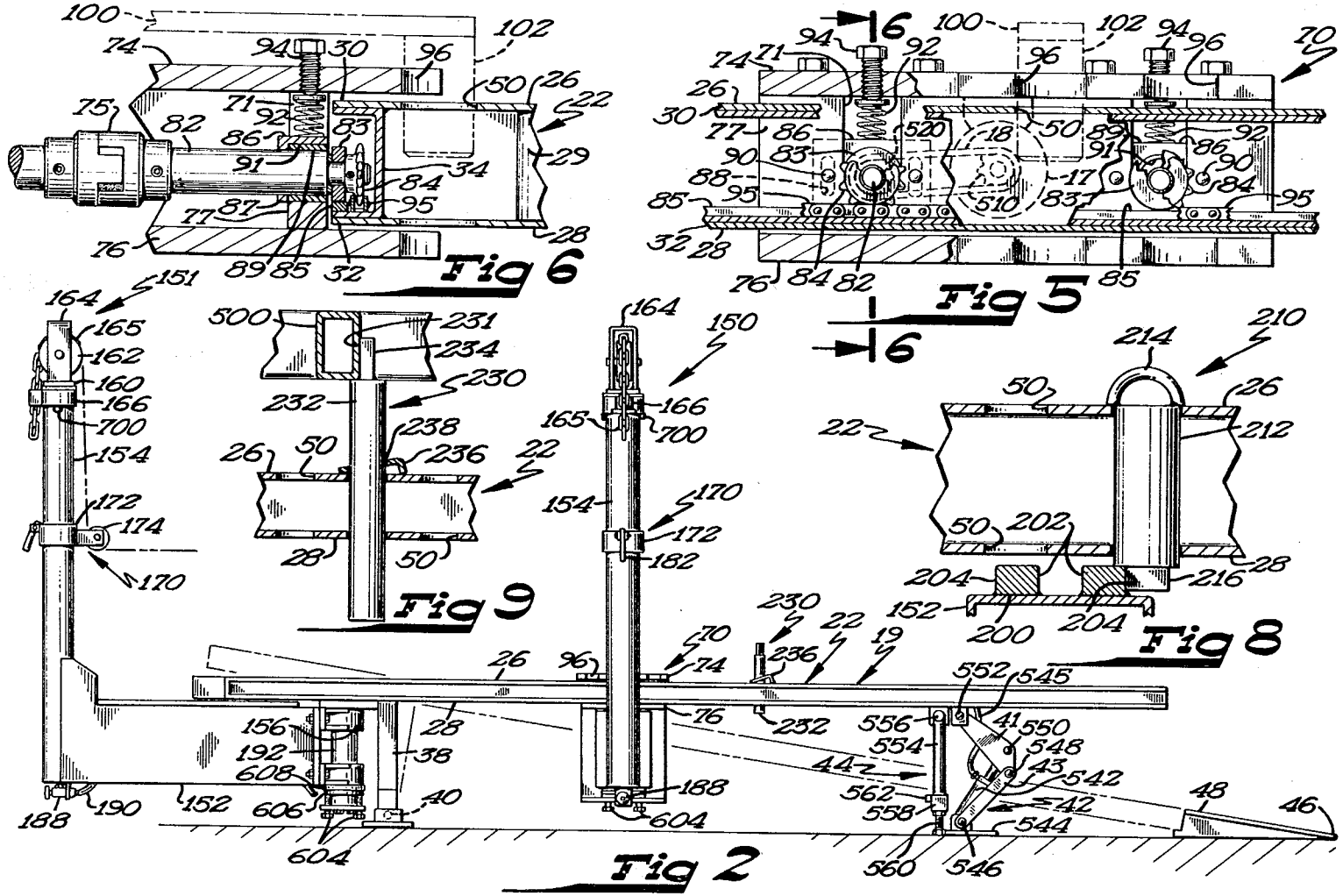
FIG. 2 is a side elevation view of an apparatus for repairing and straightening the body and frame of a vehicle having a tram according to the teachings of the present invention.
FIG. 5 is a sectional view taken along section line 5—5 in FIG. 4.
FIG. 6 is a partial sectional view taken along section line 6—6 in FIG. 5.
FIG. 8 is a partial sectional view taken along section line 8—8 in FIG. 4.
FIG. 9 is a partial sectional view taken along section line 9—9 in FIG. 3.

The remaining figures of the drawings of the present invention and the remaining disclosure of the present invention, including preferred embodiments, are incorporated herein by reference to application Ser. No. 496,848 filed Aug. 12, 1974, by Gerald A. Specktor, entitled "Apparatus for Repairing and Straightening", now U.S. Pat. No. 4,151,737, the parent application of the present application.

What is claimed is:

1. Tram for use in an apparatus for repairing and straightening the body and frame of a wheeled vehicle comprising, in combination: a tram carrier member including at least a first side wall and a second side wall; with the first side wall including a first U-shaped aperture and with the second side wall including a second U-shaped aperture; at least one shaft engaging with the apparatus for repairing and straightening, with the shaft extending through the tram carrier member and having a first end extending through the first U-shaped aperture formed in the first side wall and having a second end extending through the second U-shaped aperture formed in the second side wall; first shaft retainer slidably mounted to the first side wall for capturing the shaft within the first U-shaped aperture of the first side wall; second shaft retainer slidably mounted to the second side wall for capturing the shaft within the second U-shaped aperture of the second side wall; first means for biasing the first shaft retainer and allowing the shaft to deflect under a load condition; second means for biasing the second shaft retainer and allowing the shaft to deflect under a load condition; and means for receiving counterforces wherein under a load condition, the shaft deflects and thus is subjected only to the initial force while the means for receiving the counterforce receives the major counterforce.

2. The tram of claim 1 further comprising, in combination: means for allowing the shaft to flex adjacent its center under a load condition.

3. The tram of claim 1 wherein the means for receiving the counterforce comprises, in combination: a tram top, and a tram bottom, with the tram carrier member including the tram top and the tram bottom wherein under a load condition, the tram top and tram bottom engage with a portion of the apparatus for repairing and straightening.

4. The tram of claim 4 wherein the apparatus for repairing and straightening includes a right track member and a left track member spaced from the right track member, with the right and left track members having a top surface and a bottom surface and having a first flange, with the first end of the shaft engaging the first flange of the right track member and the second end of the shaft engaging the first flange of the left track member; and wherein under a load condition, the tram top contacts the top surface and the tram bottom contacts the bottom surface of the apparatus for repairing and straightening.

5. The tram of claim 4 wherein the apparatus for repairing and straightening further comprises a tread member arranged for allowing support of the vehicle thereon and wherein the right and left track members are formed in the tread member.

6. The tram of claim 4 further comprising, in combination: means for rotating the shaft; and means operatively connected to the shaft for converting the rotation of the shaft to cause movement of the tram in the apparatus for repairing and straightening.

7. The tram of claim 6 wherein the converting means comprises, in combination: a first stationary, elongated gear member located on the right track member; a second stationary, elongated gear member located on the left track member parallel to the first gear member; a first sprocket member located on the first end of the shaft and engaging the first gear member; and a second sprocket located on the second end of the shaft and engaging the second gear member thereby forming a rack and pinion gear arrangement such that, as the shaft is rotated, the first and second sprockets mesh with the first and second stationary gear members.

8. The tram of claim 1 further comprising, in combination: means for rotating the shaft; and means operatively connected to the shaft for converting the rotation of the shaft to cause movement of the tram in the apparatus for repairing and straightening.

9. The tram of claim 6 or 8 wherein the converting means comprises, in combination: at least one stationary, elongated gear member attached to the apparatus for repairing and straightening, and at least one sprocket attached to the shaft which meshes with the stationary, elongated gear member.

10. The tram of claim 9 further comprising a roller mounted on the shaft adjacent to the sprocket for reducing the amount of weight carried by the sprocket.

11. The tram of claim 10 further comprising a rail portion formed adjacent to the stationary gear member upon which the roller rides.

12. The tram of claim 9 wherein the stationary, elongated gear member comprises chain links fastened to the apparatus for repairing and straightening.

13. The tram of claim 1 or 3 further comprising, in combination: at least one means for applying force to the vehicle; and means for pivotally interconnecting the force applying means to the tram carrier member.

14. The tram of claim 13 wherein the pivotally interconnecting means comprises, in combination: a small cylindrical pivot member attached to the tram carrier member; a connector arm extending from the force applying means to a point adjacent to the pivot member; and means for pivotally mounting the connector arm to the pivot member and for allowing the counterforce applied to the connnector arm by the force applying means to be conveyed to the pivot member from any direction comprising, in combination: a clamp member pivotally connected about the pivot member, and a ring sleeve type bearing located between the clamp member and the pivot member.

15. The tram of claim 14 wherein the pivotally interconnecting means further comprises, in combination: means for positioning and leveling the connector arm on the pivot member comprising, in combination: a thrust plate; and adjustment screws abutting the thrust plate, wherein the means for pivotally mounting the connector arm to the pivot member and for allowing the counterforce applied to the connector arm by the force applying means to be conveyed to the pivot member from any direction operatively rests on the thrust plate.

16. The tram of claim 15 wherein the pivotally interconnecting means further comprises, in combination: means for reducing the friction between the thrust plate and the means for pivotally mounting the connector arm to the pivot member and for allowing the counterforce applied to the connector arm by the force applying means to be conveyed to the pivot member from any direction.

17. The tram of claim 13 wherein the pivotally interconnecting means comprises, in combination: a small cylindrical pivot member attached to the tram carrier member; a connector arm extending from the force applying means to a point adjacent the pivot member; means for pivotally mounting the connector arm to the pivot member; and means for positioning and leveling the connector arm on the pivot member comprising, in combination: a thrust plate, and adjustment screws abutting the thrust plate, wherein the means for pivotally mounting the connector arm to the pivot member operatively rests on the thrust plate.

18. The tram of claim 17 further comprising, in combination: means for reducing the friction between the thrust plate and the means for pivotally mounting the connector arm to the pivot member.

19. The tram of claim 4 wherein the apparatus for repairing and straightening further includes a plurality of apertures passing vertically through the top surface of the right and left track members; and wherein the tram further includes means for locking the tram carrier member in a stationary position with respect to the track members comprising, in combination: elongated member having a first end and a second end, and at least one projection located adjacent an end of the elongated member, with the projection having a shape able to extend into the apertures, and removed portions formed on the tram carrier member wherein the projection extends into the removed portions and into the apertures to securely hold the tram carrier member in a stationary position.

20. The tram of claim 19 wherein the locking means includes a first projection located adjacent the first end of the elongated member and a second projection located adjacent the second end of the elongated member.

21. The tram of claim 13 wherein the force applying means includes a hydraulic cylinder; wherein the tram further comprises a hydraulic unit for supplying hydraulic fluid to the hydraulic cylinder of the force applying means; and a tram hydraulic unit cavity for receiving the tram hydraulic unit.

22. The tram of claim 4 wherein, under a no load condition, the means for receiving the counterforce is spaced from the top surface and the bottom surface of the right and left track members to reduce the sliding friction to a minimal amount.

23. The tram of claim 1 or 4 wherein the retainers include a flat plate having vertical slots and an inverted U-shaped removed portion, with the retainers being slidably mounted to the side walls by projections which extend from the side walls through the vertical slots of the retainers, and wherein the shaft is located within the U-shaped removed portion.

24. The tram of claim 3 wherein, under a no load condition, the means for receiving the counterforce is spaced from the apparatus for repairing and straightening to reduce the sliding friction to a minimal amount.

* * * * *